US011060162B2

(12) United States Patent
Lee et al.

(10) Patent No.: US 11,060,162 B2
(45) Date of Patent: Jul. 13, 2021

(54) NON-ORIENTED ELECTRICAL STEEL SHEET AND MANUFACTURING METHOD THEREFOR

(71) Applicant: POSCO, Pohang-si (KR)

(72) Inventors: Se Il Lee, Pohang-si (KR); June Soo Park, Pohang-si (KR); Jae Hoon Kim, Pohang-si (KR)

(73) Assignee: POSCO, Pohang-si (KR)

( * ) Notice: Subject to any disclaimer, the term of this patent is extended or adjusted under 35 U.S.C. 154(b) by 44 days.

(21) Appl. No.: 16/470,784

(22) PCT Filed: Dec. 19, 2017

(86) PCT No.: PCT/KR2017/015027
§ 371 (c)(1),
(2) Date: Jun. 18, 2019

(87) PCT Pub. No.: WO2018/117602
PCT Pub. Date: Jun. 28, 2018

(65) Prior Publication Data

US 2020/0087748 A1 Mar. 19, 2020

(30) Foreign Application Priority Data

Dec. 19, 2016 (KR) ..... 10-2016-0173568

(51) Int. Cl.
*C21D 9/46* (2006.01)
*C22C 38/16* (2006.01)
(Continued)

(52) U.S. Cl.
CPC ..... *C21D 9/46* (2013.01); *C21D 6/005* (2013.01); *C21D 6/008* (2013.01); *C21D 8/005* (2013.01);
(Continued)

(58) Field of Classification Search
CPC ..... C21D 6/005; C21D 6/008; C21D 8/005; C21D 8/1222; C21D 8/1261;
(Continued)

(56) References Cited

U.S. PATENT DOCUMENTS 4,439,251 A 3/1984 Shimoyama et al.
2015/0027590 A1* 1/2015 Nakanishi ..... C22C 38/002 148/111
(Continued)

FOREIGN PATENT DOCUMENTS

CN 1078270 A 11/1993
CN 104674136 A 6/2015
(Continued)

OTHER PUBLICATIONS

Extended European Search Report dated Aug. 23, 2019 issued in European Patent Application No. 17885138.2.
(Continued)

*Primary Examiner* — Jenny R Wu
(74) *Attorney, Agent, or Firm* — Morgan, Lewis & Bockius LLP

(57) ABSTRACT

The non-oriented electrical steel sheet according to one embodiment of the present invention includes: by weight, 2.0% to 4.0% of Si; 0.001% to 2.0% of Al; 0.0005% to 0.009% of S; 0.02% to 1.0% of Mn, 0.0005% to 0.004% of N; 0.004% or less of C (excluding 0%); 0.005% to 0.07% of Cu; 0.0001% to 0.007% of O; individually or in a total amount of 0.05% to 0.2% of Sn or P; and the remainder comprising Fe and impurities; wherein the non-oriented electrical steel sheet is composed of a surface portion to 2 μm from the surface of the steel sheet in the thickness direction and a base portion exceeding 2 μm from the surface of the steel sheet in the thickness direction, and wherein the number of surfides having a diameter of 10 nm to 100 nm is
(Continued)

larger than the number of the nitrides having a diameter of 10 nm to 100 nm, in the same area of base portion.

16 Claims, 1 Drawing Sheet

(51) Int. Cl.

| | |
|---|---|
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/12*** | (2006.01) |
| ***C21D 8/00*** | (2006.01) |
| ***C21D 6/00*** | (2006.01) |
| ***H01F 1/147*** | (2006.01) |

(52) U.S. Cl.
CPC ..... *C21D 8/1272* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/16* (2013.01); *H01F 1/14775* (2013.01); *C22C 2202/02* (2013.01)

(58) Field of Classification Search
CPC .... C21D 8/1272; C21D 9/46; C22C 2202/02; C22C 38/001; C22C 38/002; C22C 38/008; C22C 38/02; C22C 38/04; C22C 38/06; C22C 38/08; C22C 38/12; C22C 38/14; C22C 38/16; C22C 38/18; C22C 38/60; H01F 1/14775; H01F 1/16
See application file for complete search history.

(56) References Cited

U.S. PATENT DOCUMENTS

| | | | | |
|---|---|---|---|---|
| 2015/0270042 | A1* | 9/2015 | Toda | C22C 38/04 420/84 |
| 2017/0314090 | A1 | 11/2017 | Okubo et al. | |

FOREIGN PATENT DOCUMENTS

| | | | | |
|---|---|---|---|---|
| EP | 2818564 | A1 | | 12/2014 |
| EP | 2910658 | A1 | | 8/2015 |
| JP | S55-047320 | A | | 4/1980 |
| JP | H08-333658 | A | | 12/1996 |
| JP | 2002-356752 | A | | 12/2002 |
| JP | 2006-169611 | A | | 6/2006 |
| JP | 2009-263782 | A | | 11/2009 |
| JP | 4790151 | B2 | | 10/2011 |
| JP | 5445194 | B2 | | 3/2014 |
| JP | 2015-508454 | A | | 3/2015 |
| JP | 2015-206092 | A | | 11/2015 |
| JP | 2016003371 | A | | 1/2016 |
| JP | 2016-156044 | A | | 9/2016 |
| KR | 10-2008-0106330 | A | | 12/2008 |
| KR | 10-2012-0013710 | A | | 2/2012 |
| KR | 10-2013-0001532 | A | | 1/2013 |
| KR | 10-2013-0076547 | A | | 7/2013 |
| KR | 20130076547 | A | * | 7/2013 |
| KR | 10-2013-0127295 | A | | 11/2013 |
| KR | 10-2014-0058935 | A | | 5/2014 |
| KR | 10-2015-0073800 | A | | 7/2015 |
| KR | 10-2015-0126699 | A | | 11/2015 |
| KR | 10-2016-0061797 | A | | 6/2016 |
| KR | 10-1634092 | A | | 6/2016 |
| KR | 10-2016-0078134 | A | | 7/2016 |

OTHER PUBLICATIONS

M. Kodym, et al., "5 Spurenelemente im Stahl—Moglichkeiten zur Beeinflussung im Schmelzbetrieb," Jan. 1, 1985, pp. 19-22, XP002433212.
International Search Report dated Apr. 11, 2018 issued in corresponding International Patent Application No. PCT/KR2017/015027.
Japanese Office Action dated Aug. 4, 2020 issued in Japanese Patent Application No. 2019-532678.
European Office Action dated Jun. 29, 2020 issued in European Patent Application No. 17885138.2.
Chinese Office Action dated Jul. 3, 2020 issued in Chinese Patent Application No. 201780077554.3.
European Office Action dated Feb. 22, 2021 issued in European Patent Application No. 17885138.2.
L. Holappa, "On Physico-Chemical and Technical Limits in Clean Steel Production," vol. 81, No. 10, Oct. 1, 2010, pp. 869-874.

* cited by examiner

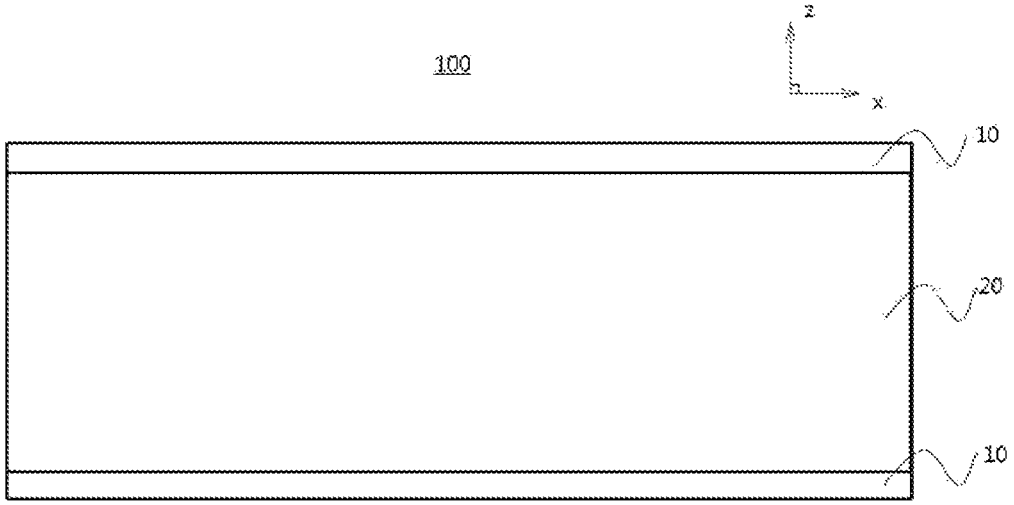
100
z
x
10
20
10

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015027, filed on Dec. 19, 2017, which in turn claims the benefit of Korean Patent Application No. 10-2016-0173568, filed Dec. 19, 2016, the entire disclosures of which applications are incorporated by reference herein.

TECHNICAL FIELD OF THE INVENTION

The present disclosure relates to a non-oriented electrical steel sheet and a manufacturing method thereof.

BACKGROUND OF THE INVENTION

The non-oriented electric steel sheet has a critical influence on the energy efficiency of the electric equipments. The non-oriented electric steel sheet is usually used as a material for iron cores in rotating devices such as motors and generators and stationary devices such as small transformers, converting electrical energy into mechanical energy. At this time, the magnetizing force generated by the electric energy is greatly amplified by the iron core, thereby generating the rotational force and converting it into mechanical energy.

Recently, there have been some cases where the non-oriented electric steel sheet is used as an antenna for a magnetic signal by using the characteristics of amplifying magnetizing force among the characteristics of such non-oriented electrical steel sheet. The magnetic signal is a frequency of several hundred Hz to several thousand Hz. Further, in order to amplify it, the magnetic permeability characteristic at the frequency above is important. The relative magnetic permeability of the non-oriented electrical steel sheet at the normal frequency is more than 5000 around at IT and has the maximum magnetic permeability. The oriented electrical steel sheet has a high magnetic permeability characteristic ranging from several times to several tens of times.

On the other hand, the magnetic permeability exhibits a property of facilitating magnetization under a small magnetic field formed by a low electric current. In the case of a high magnetic permeability material, the same magnetic flux density can be obtained even when a smaller current is applied or a large magnetic flux density can be obtained at the same current. Thus, it is advantageous for a signal transmission.

Further, by using a material having a high magnetic permeability, the signal of the corresponding frequency section can be guided to the steel plate and used as an effect of shielding the signal inside. The higher the magnetic permeability at this time, the greater the shielding effect can be obtained with a thinner steel plate.

Above a frequency range higher than several tens of kHz, amorphous ribbons or magnetic materials such as soft ferrite and the like has magnetic permeability superior to the magnetic permeability of the steel sheet material, and has low loss characteristics and can be used instead of the electric steel sheet material.

In order to improve the magnetic permeability characteristic of the electric steel sheet, a texture improvement method is generally used in which the [001] axis is arranged on the surface of the sheet to utilize the magnetic anisotropy of the iron atoms. However, in the case of a directional electric steel sheet in which such a texture is well arranged, there are many restrictions on the use such as high manufacturing cost and inferior processability. In the case of amorphous materials, they have extremely high magnetic permeability because the magnetic domains are extremely fine or non-existent. However, they are expensive to manufacture and cannot be precisely processed due to brittleness. Thus, non-oriented electrical steel sheet materials are used.

The magnetic permeability refers to the change in the magnetic flux in the material due to the change in the external magnetic field, and the change in magnetic flux is caused by the magnetization process. Magnetization occurs as a mechanism in which the magnetic domain wall in the material moves and aligns in the direction of the external magnetic field. The width of the magnetic domain, which is the distance between the magnetic domain walls, is known to be independent of frequency in the range of several tens Hz to several tens of Hz. Accordingly, in order to obtain a high magnetic permeability characteristic, when the magnetic wall moves, the moving speed must be high and the width of the magnetic domain must be narrow. Especially, at a high frequency of several thousands Hz, the magnetization speed is reversed extremely rapidly. Thus, for the material having consistent domain wall moving speed, it may be more advantageous when the width of the magnetic domain.

DETAILS OF THE INVENTION

Problems to be Solved

An embodiment of the present invention is to provide a non-oriented electrical steel sheet having a high magnetic permeability, in which the width of the magnetic domain is reduced by using carbide, nitride, sulfide, oxide, or the like, which are non-magnetic precipitates contained in the electric steel sheet and the domain wall moving speed is increased to increase the magnetic permeability at high frequency, and a manufacturing method of the same.

Means to Solve the Problems

The non-oriented electrical steel sheet according to one embodiment of the present invention includes: by weight, 2.0% to 4.0% of Si; 0.001% to 2.0% of Al; 0.0005% to 0.009% of S; 0.02% to 1.0% of Mn, 0.0005% to 0.004% of N; 0.004% or less of C (excluding 0%); 0.005% to 0.07% of Cu; 0.0001% to 0.007% of O; individually or in a total amount of 0.05% to 0.2% of Sn or P; and the remainder comprising Fe and impurities; wherein the non-oriented electrical steel sheet is composed of a surface portion up to 2 μm from the surface of the steel sheet in the thickness direction and a base portion over 2 μm from the surface of the steel sheet in the thickness direction, and wherein the number of surfides having a diameter of 10 nm to 100 nm is larger than the number of the nitrides having a diameter of 10 nm to 100 nm, in the same area of base portion.

The sum of the number of sulfides having a diameter of 10 nm to 100 nm and the number of nitrides having a diameter of 10 nm to 100 nm, in the base portion, may be 1 to 200 per area of 250 $\mu m^2$.

The number of oxides having a diameter of 10 nm to 100 nm may be larger than the sum of the number of carbides, nitrides, and sulfides having a diameter of nm to 100 nm, in the same area of the surface portion.

The number of oxides having a diameter of 10 nm to 100 nm in the surface portion may be 1 to 200 per area of 250 $\mu m^2$.

The non-oriented electrical steel sheet according to one embodiment of the present invention can satisfy the following Formula 1.

$$[Sn]+[P]>[Al] \quad \text{[Formula 1]}$$

([Sn], [P], and [Al] represent the contents of Sn, P and Al (% by weight), respectively.)

0.0005 to 0.003% by weight of Ti; 0.0001% to 0.003% by weight of Ca; and individually or in a total amount of 0.005% to 0.2% by weight of Ni or Cr may be further comprised.

0.005 wt % to 0.15 wt % of Sb may be further comprised.

0.001 wt. % to 0.015 wt. % of Mo may be further comprised.

At least one of Bi, Pb, Mg, As, Nb, Se and V may be further comprised individually or in an amount of 0.0005 to 0.003% by weight.

And the average grain diameter may be 50 to 200 μm.

The relative magnetic permeability in a condition of Bm=1.0 T at 50 Hz may exceed 8,000; the relative magnetic permeability in a condition of Bm=1.0 T at 400 Hz may exceed 4,000; the relative magnetic permeability in a condition of Bm=0.3 T at 1000 Hz may exceed 2,000.

A manufacturing method of non-oriented electrical steel sheet according to one embodiment of the present invention may include: heating the slab including, by weight, 2.0% to 4.0% of Si; 0.001% to 2.0% of Al; 0.0005% to 0.009% of S; 0.02% to 1.0% of Mn; 0.0005% to 0.004% of N; 0.004% or less of C (excluding 0%); 0.005% to 0.07% of Cu; 0.0001% to 0.007% of O; individually or in a total amount of 0.05% to 0.2% of Sn or P; and the remainder comprising Fe and impurities; hot-rolling the slab to produce a hot-rolled sheet; annealing the hot-rolled sheet by hot-rolling; cold-rolling the annealed hot-rolled sheet to produce a cold-rolled sheet; and final annealing the cold-rolled sheet. The step of annealing the hot-rolled sheet and the step of final annealing may satisfy the following Formula 2.

$$[\text{Hot-rolled sheet annealing temperature}]\times[\text{Hot-rolled sheet annealing time}]>[\text{Final annealing temperature}]\times[\text{Final annealing time}] \quad \text{[Formula 2]}$$

([Hot-rolled sheet annealing temperature] and [Final annealing temperature] indicate the temperature (° C.) in the hot-rolled sheet annealing step and the final annealing step, respectively, and [Hot-rolled sheet annealing time] and [Final annealing time] indicate the time (minutes) in the hot-rolled sheet annealing step and the final annealing step, respectively.)

The final annealed non-oriented electrical steel sheet may be composed of a surface portion up to 2 μm from the surface of the steel sheet in the thickness direction and a base portion over 2 μm from the surface of the steel sheet in the thickness direction, and the number of sulfides having a diameter of 10 nm to 100 nm may be larger than the number of nitrides having a diameter of 10 nm to 100 nm in the same area of the base portion.

The slab may be heated at a temperature of from 1100° C. to 1200° C. in the step of heating the slab.

The annealing may be performed at a temperature of 950° C. to 1150° C. for 1 minute to 30 minutes in the step of annealing the hot-rolled steel sheet.

The annealing may be performed at a temperature of 900° C. to 1150° C. for 1 minute to 5 minutes in the final annealing step.

The step of producing the cold-rolled sheet may include a step of cold-rolling once or a step of cold-rolling at least two times with intermediate annealing in between.

Effects of the Invention

The embodiment of the present invention can produce a non-oriented electrical steel sheet having improved magnetic permeability at tens to thousands of Hz by controlling the alloy composition and precipitates to be precipitated in the steel.

BRIEF DESCRIPTION OF THE DRAWINGS

FIG. 1 is a schematic view of a cross section of a non-oriented electrical steel sheet according to an embodiment of the present invention.

DETAILED DESCRIPTIONS OF THE INVENTION

The terms "first," "second," "third" and the like are used to illustrate different parts, components, areas, layers and/or sections, but are not limited thereto. The terms are only used to differentiate a specific part, component, area, layer or section from another part, component, area, layer or section. Accordingly, a first part, component, area, layer or section, which will be mentioned hereinafter, may be referred to as a second part, component, area, layer or section without departing from the scope of the present disclosure.

The technical terms used herein are set forth to mention specific embodiments of the present disclosure and do not intend to define the scope of the present disclosure. The singular number used here includes the plural number as long as the meaning of the singular number is not distinctly opposite to that of the plural number. The term "have," used herein refers to the concretization of a specific characteristic, region, integer, step, operation, element and/or component, but does not exclude the presence or addition of other characteristic, region, integer, step, operation, element and/or component.

When it is said that any part is positioned "on" or "above" another part, it means the part is directly on the other part or above the other part with at least one intermediate part. In contrast, if any part is said to be positioned "directly on" another part, it means that there is no intermediate part between the two parts.

Unless otherwise specified, all the terms including technical terms and scientific terms used herein have the same meanings commonly understandable to those skilled in the art relating to the present disclosure. The terms defined in generally used dictionaries are additionally interpreted to have meanings corresponding to relating scientific literature and contents disclosed now, and are not interpreted either ideally or very formally unless defined otherwise.

Unless otherwise stated, % means % by weight, and 1 ppm is 0.0001% by weight. In an embodiment of the present invention, the term "further includes an additional element" means an additional amount of the additional element substituted for the remainder of iron (Fe).

Hereinafter, embodiments of the present invention will be described in detail so that those skilled in the art can easily carry out the present invention. The present invention may, however, be embodied in many different forms and should not be construed as limited to the embodiments set forth herein.

The non-oriented electrical steel sheet according to one embodiment of the present invention includes, by weight, 2.0% to 4.0% of Si; 0.001% to 2.0% of Al; 0.0005% to 0.009% of S; 0.02% to 1.0% of Mn, 0.0005% to 0.004% of N; 0.004% or less of C (excluding 0%); 0.005% to 0.07% of Cu; 0.0001% to 0.007% of O; individually or in a total amount of 0.05% to 0.2% of Sn or P; and the remainder comprising Fe and impurities.

First, the reason for limiting the components of the non-oriented electrical steel sheet will be described.

Si: 2.0 to 4.0 wt %

Silicon (Si) is a major element added because it increases the resistivity of the steel to lower the vortex loss in iron loss. When the Si content is less than 2.0%, it is difficult to obtain low iron loss characteristics at high frequencies. When the Si content exceeds 4.0%, cold rolling is extremely difficult because plate breakage may occur during rolling. In the embodiment of the present invention, Si is limited to 2.0 to 4.0% by weight.

Al: 0.001 to 2.0 wt %

Aluminum (Al) is a non-resistive element which is effective for reducing vortex loss induced in steel during addition and is inevitably added for steel deoxidation in steelmaking process. Therefore, the formation of nitrides bound to aluminum in the steel is inevitably caused. In the steelmaking process, Al is present in the steel in an amount of 0.001% or more. When it is less than 0.001%, AlN is not formed in the steel. Al is limited to 0.001% by weight to 2.0% by weight because, when a large amount of Al is added, it decreases the saturation magnetic flux density and forms AlN having a size of 100 nm or more to inhibit crystal grain growth and interfere the magnetic domain movement to lower magnetic permeability.

S: 0.0005 to 0.009 wt %

In the prior art, it was known that it is preferable to add sulfur (S) as low as possible, because sulfur is an element which forms sulfide such as MnS, CuS, and (Cu, Mn) S, which are harmful to the magnetic properties.

In an embodiment of the present invention, a suitable amount of sulfide has the effect of reducing the width of the magnetic domain in the steel. In addition, since S has an effect of lowering the surface energy of the {100} plane when segregated on the surface of steel, addition of S can provide a {100} planar texture that is advantageous for magnetism. If the addition amount is less than 0.0005 wt %, it is difficult to form a sulfide having a size of 10 nm to 100 nm. Therefore, the amount of the sulfide is necessarily 0.0005 wt % or more. When it is added in an amount exceeding 0.009% by weight, the number of sulfides is greatly increased, and the magnetic domain movement is difficult and the iron loss is deteriorated. Therefore, the addition amount is limited to 0.009% by weight or less. Mn: 0.02 to 1.0 wt %

Manganese (Mn) has an effect of increasing the specific resistance and lowering the iron loss by addition of Si and Al. Whereas when it is less than 0.02%, which is added as an impurity in steelmaking, it forms fine sulfide and interferes the movement of the magnetic wall. The addition amount is limited to 0.02% or more. In addition, as the Mn content increases, the number of sulfide in the steel increases, and the saturation flux density decreases. Therefore, when a constant current is applied, the magnetic flux density decreases and the magnetic permeability also decreases. Therefore, in order to improve the magnetic flux density and prevent the increase of iron loss due to inclusions, the Mn addition amount is limited to 0.02 to 1.0 wt % in one embodiment of the present invention.

N: 0.0005 to 0.004 wt %

Nitrogen (N) is preferably contained in a small amount because it is an element which is detrimental to magnetism by forming nitrides by strongly binding with Al, Ti or the like to inhibit crystal growth. However, it is difficult to form nitride at less than 0.0005 wt %. The number of nitrides is greatly increased at more than 0.004 wt %. Thus, it is limited to 0.0005 wt % to 0.004 wt % in one embodiment of the present invention. Specifically, it is comprised in 0.001 to 0.004% by weight. C: 0.004% by weight or less Carbon (C), when it is added a lot, expands the austenite region, increases the phase transformation period, inhibits the crystal growth of ferrite during annealing, increases the iron loss, and combines with Ti or the like to form carbide to deteriorate magnetism. The iron loss is increased by magnetic aging at the time of use after processing a final product to an electrical product. Thus, the content of C is limited to 0.004% or less in one embodiment of the present invention.

Cu: 0.005 to 0.07 wt %

Copper (Cu) is an element capable of forming a sulfide at a high temperature, and when added in a large amount, it causes defects on the surface portion in the production of the slab. When added in an appropriate amount, Cu alone or in the form of inclusions is finely distributed to reduce the width of the magnetic domain. Therefore, the addition amount is limited to 0.005 to 0.07% by weight.

O: 0.0001 to 0.007 wt %

Oxygen (O) exists as an oxide in the steel. When a large amount of Si and Al are added in the steel, oxygen (O) is combined with Si and Al, respectively, to form an oxide, which interferes with the movement of the magnetic domain to decrease magnetic permeability. Therefore, the addition amount is limited to 0.0001 to 0.007% by weight. Specifically, the addition amount is limited to 0.0001 to 0.005% by weight.

Sn, and P: individually or in a total amount of 0.05 to 0.2 wt %

Tin (Sn) and phosphorus (P) inhibit the diffusion of nitrogen through the grain boundaries as a segregated element in the grain boundaries and suppress the {111} texture detrimental to magnetism and increase the advantageous {100} texture to increase magnetic property. Further, it has an effect of inhibiting the formation of oxides and nitrides on the surface of the steel. When added in a large amount, Sn and P may be added individually or in a total amount of 0.05 to 0.2% by weight in order to cause breakage of grain boundaries and to make rolling difficult. The term "individually or in a total amount" means that when Sn is only included among Sn and P, the content of Sn is 0.05 to 0.2% by weight; when P is only included among Sn and P, the content of P is 0.05 to 0.2% by weight; or when Sn and P are both included, the sum of the contents of Sn and P is 0.05 to 0.2% by weight.

The aforementioned Sn, P and Al can satisfy the following Formula 1.

$$[Sn]+[P]>[Al] \quad \text{[Formula 1]}$$

(Here, [Sn], [P] and [Al] represent the content (% by weight) of Sn, P and Al, respectively.)

When Sn or P is not included, [Sn] or [P] represents 0. When the Formula 1 is satisfied, Sn and P, which are elements for slowing down the dislocation loosening occurring during annealing, are higher than Al, which is an element for accelerating dislocation loosening, so that the growth of crystals favorable to magnetism during annealing is accelerated. Thus, a non-oriented electrical steel sheet having superior magnetic property can be obtained.

Ti: 0.0005 to 0.003 wt %

Titanium (Ti) forms fine carbides and nitrides to inhibit grain growth. As the amount of titanium is increased, carbides and nitrides increase, resulting in a dislocation of the texture and deterioration of magnetism. In one embodiment of the present invention, Ti is an optional component, and when Ti is included, the content of Ti is limited to 0.0005 to 0.003 wt %.

Ca: 0.0001 to 0.003 wt %

Calcium (Ca) is an element that improves performance and precipitates S in steel. When a large amount of Ca is present in the steel, a complex precipitate including S is formed to adversely affect the iron loss, but if too much is included, the crystal growth rate is increased. In one embodiment of the present invention, Ca is an optional component. When Ca is included, the content of Ca is limited to 0.0001 to 0.003% by weight.

Ni or Cr: 0.005 to 0.2% by weight %

Nickel (Ni) or chromium (Cr) can inevitably be added in the steelmaking process. They react with impurity elements to form fine sulfides, carbides and nitrides, which have harmful effects on the magnetism. Therefore, these contents are limited to 0.005 to 0.2% by weight, individually or in a total amount.

Sb: 0.005 to 0.15 wt %

Antimony (Sb) may be optionally added, because it suppresses the diffusion of nitrogen through grain boundaries as a segregated element in the grain boundaries, slows the growth of the {111} texture and the speed of recrystallization, which is harmful to magnetism, and thus improves the magnetic properties. Further, it has an effect of hindering the formation of oxides on the surface of the steel. When a large amount of Sb is added, it may cause a breakage from grain boundaries and make it difficult to roll. Therefore, Sb alone can be added in an amount of 0.005 to 0.15% by weight.

Mo: 0.001 wt % to 0.015 wt %

Molybdenum (Mo) is advantageous in securing the toughness of steel segregated at grain boundaries at high temperatures, when P, Sn, Sb, or the like, which are the segregated elements in steel, are added, and overcoming the brittleness of Si to greatly improve the production. It is also possible to form a carbide which bonds with C and to control the shape of the magnetic domain through the carbide. When the addition amount is too large, the number of precipitates is greatly increased and the iron loss is deteriorated, thereby limiting the addition amount.

Other Elements

Bi, Pb, Mg, As, Nb, Se, and V are elements that form strong inclusions and form complex precipitates including carbides, nitrides and sulfide. They are located at the grain boundaries and deteriorate the rolling property. It is preferable that they are not added and they are contained individually or in a total amount of 0.0005 to 0.003% by weight.

In addition to the above composition, the remainder is composed of Fe and other unavoidable impurities.

FIG. 1 schematically shows a cross section of a non-oriented electrical steel sheet according to an embodiment of the present invention. As shown in FIG. 1, the non-oriented electrical steel sheet 100 according to an embodiment of the present invention may be composed of a surface portion 10 up to 2 μm from the surface of the steel sheet in the thickness direction (z direction) and a support portion 20 over 2 μm from the surface of the steel sheet in the thickness direction. The above-mentioned alloy composition is the alloy composition in both the surface portion 10 and the base portion 20.

In the same area of the base portion 20, the number of sulfides having a diameter of 10 nm to 100 nm is larger than the number of nitrides having a diameter of 10 nm to 100 nm. The same area means any arbitrary same area when observing the base portion 20 in a plane parallel to the surface of the steel sheet. The diameter of the sulfide or nitride means the diameter of a virtual circle circumscribing inclusions such as sulfide and nitrides. In an embodiment of the present invention, by limiting the relationship between the sulfide and the nitride of a specific size in the base portion 20, the energy required for forming the magnetic domain wall is reduced to increase the generation of the magnetic domain wall. It is possible to manufacture a non-oriented electrical steel sheet having a significantly improved magnetic permeability at high frequencies by accelerating the progress of magnetization through the movement of the magnetic wall. The magnetization is a state in which the magnetic domain walls move and the crystal grains or the entire steel sheet align the magnetic domains in the direction of the magnetic flux. Therefore, the direction of the magnetic flux changes at a very high speed under high frequency. The limit of the movement of magnetic wall is clear, and the process of magnetization through the movement of the magnetic wall becomes unfavorable. Therefore, in order to improve the magnetic permeability even under a high frequency, it is advantageous to reduce the distance between the magnetic domain walls so that magnetization rapidly occurs. By keeping the magnetic domain wall moving speed at the same and reducing the distance between the magnetic domain walls, the magnetic permeability under high frequency can be greatly improved. In one embodiment of the present invention, the diameter of the inclusions such as sulfide, nitride and the like may be set to 10 nm to 100 nm because the generation of the magnetic domain walls and the magnetic domain migration are most influenced by the diameters in the above range. If the diameter is too small, it does not help to induce energy for the formation of the magnetic wall. On the contrary, if the diameter is too large, the movement of the magnetization wall is disturbed when magnetized, and the wall moving speed is slowed.

More specifically, the number of sums of the sulfides having a diameter of 10 nm to 100 nm and the nitrides having a diameter of 10 nm to 100 nm in the supporting portion 20 can be 1 to 200 per area of 250 $\mu m^2$. Assuming general magnetic wall and magnetic thickness, surfides and nitrides required to reduce the width of the magnetic domain are at least 1 per area of 250 $\mu m^2$. In addition, the structure of the magnetic domain is complicated by the nitride and sulfide of more than 200, which limits the moving speed of the magnetic domain walls. Thus, it may be limited. More specifically, the total number of sulfide and nitrides can be from 10 to 200.

In the same area of the surface portion 10, the number of oxides having a diameter of 10 nm to 100 nm may be larger than the sum of the number of carbides, nitrides and sulfide having a diameter of 10 nm to 100 nm. In an embodiment of the present invention, by limiting the relationship between oxide and other inclusions of a specific size in the surface portion 10, it is possible to reduce the energy required to form the magnetic domain wall, thereby increasing the generation of the magnetic domain wall. It is possible to manufacture a non-oriented electrical steel sheet having a significantly improved magnetic permeability at high frequencies by accelerating the progress of magnetization through the movement of the magnetic wall.

The number of oxides having a diameter of 10 nm to 100 nm in the surface portion 10 may be 1 to 200 per area of 250 $\mu m^2$. The oxides on the surface portion are inevitably formed during annealing. They are effective to reduce the width of the magnetic domains similarly to nitrides and sulfides. However, when excessively present in the steel, they interfere with the movement of the magnetic domain walls, thereby slowing the movement speed of the magnetic domain walls. The oxide required to reduce the width of the magnetic domains is at least one per area of 250 $\mu m^2$. In addition, the structure of the magnetic domain is complicated by more than 200 oxides, which impedes the movement of the magnetic domain walls, thereby limiting the movement speed of the magnetic domain walls. Thus, it is limited. More specifically, it may be 1 to 200 per area of 250 $\mu m^2$.

The non-oriented electrical steel sheet according to an embodiment of the present invention may have an average crystal grain diameter of 50 to 200 μm. The magnetic properties of the non-oriented electrical steel sheet are superior in the above-mentioned range.

As described above, the non-oriented electrical steel sheet according to one embodiment of the present invention has a significantly improved magnetic permeability at high frequencies. Specifically, the relative magnetic permeability in a condition of Bm=1.0 T at 50 Hz may exceed 8,000, the relative magnetic permeability in a condition of Bm=1.0 T at 400 Hz may exceed 4,000, and the relative magnetic permeability in a condition of Bm=0.3 T at 1000 Hz may exceed 2,000. More specifically, the relative magnetic permeability in a condition of Bm=1.0 T at 50 Hz may exceed 10,000, the relative magnetic permeability in a condition of Bm=1.0 T at 400 Hz may exceed 5,000, and the relative magnetic permeability in a condition of Bm=0.3 at 1000 Hz may exceed 2,200. In this case, the magnetic permeability refers to the case where the magnetic properties are measured by the standard Epstein method, and the specimen is cut in parallel to the rolling direction to test.

A manufacturing method of non-oriented electrical steel sheet according to one embodiment of the present invention may include: heating the slab including, by weight, 2.0% to 4.0% of Si; 0.001% to 2.0% of Al; 0.0005% to 0.009% of S; 0.02% to 1.0% of Mn; 0.0005% to 0.004% of N; 0.004% or less of C (excluding 0%); 0.005% to 0.07% of Cu; 0.0001% to 0.007% of O; individually or in a total amount of 0.05% to 0.2% of Sn or P; and the remainder comprising Fe and impurities; hot-rolling the slab to produce a hot-rolled sheet; annealing the hot-rolled sheet by hot-rolling; cold-rolling the annealed hot-rolled sheet to produce a cold-rolled sheet; and finally annealing the cold-rolled sheet.

Hereinafter, each step will be described in detail.

First heat the slab. The reason why the addition ratio of each composition in the slab is limited is the same as the reason for limiting the composition of the non-oriented electrical steel sheet described above, so repeated description is omitted. The composition of the slab is substantially the same as that of the non-oriented electrical steel sheet because the composition of the slab does not substantially change during the manufacturing process such as hot rolling, hot rolling annealing, cold rolling and final annealing, which will be described later in the below.

The slab is charged into a heating furnace and heated to 1100 to 1200° C. It is necessary to heat at a sufficiently high temperature for the processability before hot rolling. If the heating temperature is too high, nitrides and sulfide in the steel may become coarse and may not be able to obtain sufficient precipitates of 10-100 nm size, which may affect the magnetic domain.

Next, the heated slab is hot-rolled to 2 to 2.3 mm to obtain a hot-rolled sheet. At this stage, the precipitates precipitated during the heating of the slab can be grown and dispersed. After the completion of the hot rolling, carbide and nitride are formed to reduce the distance between the walls of the magnetic domains.

Next, the hot-rolled sheet is subjected to hot-rolled sheet annealing. The hot-rolled hot-rolled sheet can be subjected to hot-rolled sheet annealing at a temperature of 950° C. to 1150° C. for 1 minute to 30 minutes. It is necessary to perform annealing at 950° C. or more for 1 minute or more at a temperature high enough to allow the carbides and nitrides produced after hot rolling to be reused. The annealing is limited for 30 minutes or less because when the annealing is performed at a temperature lower than the dissolving temperature, fine nitrides and sulfides may become coarse, thereby increasing the distance between the magnetic domain walls.

Next, the hot-rolled sheet is pickled and cold-rolled to a predetermined thickness to produce a cold-rolled sheet. But the hot-rolled sheet can be cold-rolled to a final thickness of 0.15 to 0.65 mm by applying a reduction ratio of 70 to 95%, depending on the thickness of hot-rolled sheet. The step of producing the cold-rolled sheet may include one cold rolling step or may include two or more cold rolling steps with intermediate annealing in between.

The final cold-rolled sheet is subjected to final annealing. The final annealing temperature may be 900 to 1150° C.

In one embodiment of the present invention, the annealing temperature and the annealing time in the hot-rolled sheet annealing step and the final annealing step are appropriately controlled to sufficiently leave fine surfides and nitrides, thereby narrowing the width of the magnetic domains. Specifically, the step of annealing the hot-rolled sheet and the step of the final annealing satisfy the following Formula 2.

$$[\text{Hot-rolled sheet annealing temperature}]\times[\text{Hot-rolled sheet annealing time}]>[\text{Final annealing temperature}]\times[\text{Final annealing time}] \quad \text{[Formula 2]}$$

([Hot-rolled sheet annealing temperature] and [Final annealing temperature] indicate the temperature (° C.) in the hot-rolled sheet annealing step and the final annealing step, respectively, and [Hot-rolled sheet annealing time] and [Final annealing time] indicate the time (minutes) in the hot-rolled sheet annealing step and the final annealing step, respectively.)

By satisfying the Formula 2, sulfides and nitrides formed at the final annealing are made sufficiently small, and fine sulfides and nitrides are sufficiently left to narrow the width of the magnetic domain.

The final annealed non-oriented electrical steel sheet has the above-mentioned crystal structure, and repeated explanation is omitted. In the final annealing process, all the processed structures formed in the previous cold rolling stage can be recrystallized (i.e., 99% or more).

The produced non-oriented electrical steel sheet can be subjected to an insulating coating treatment. The insulating coating may be treated with an organic, inorganic or organic composite coating, or may be treated with other insulating coatings.

Hereinafter, the present invention will be described in more detail with reference to examples. However, these embodiments are only for illustrating the present invention, and the present invention is not limited thereto.

Example 1

A slab composed of the alloy component and the balance iron and other unavoidable impurities according to Table 1 was prepared. The steel A slab was heated at 1150° C., hot-rolled to a thickness of 2.5 mm, and wound at 650° C. The hot-rolled steel sheet cooled in air was annealed at 1080° C. for 3 minutes, pickled, and then cold-rolled to a thickness of 0.15 mm. The cold-rolled specimen was annealed at 1000° C.

At this time, inclusions and precipitates were analyzed by FE-TEM for each specimen, and the components of each precipitate inclusions were examined. The results are shown in Table 2. At this time, for the number of precipitates, only the precipitates having a diameter of 10 nm to 100 nm per unit area of 250 $\mu m^2$ were selected and counted. At this time, the specimen was sampled in the thickness direction from the surface to the inside and analyzed by dividing the portion up to 2 μm from the surface as the surface portion and the portion over 2 μm from the surface as the base portion.

The magnetic permeability and iron loss of each specimen were measured using a magnetometer, and the results are shown in Table 3 below.

TABLE 1

| Steel (wt %) | Si | Al | Mn | S | N | C | Cu | O | Sn | P |
|---|---|---|---|---|---|---|---|---|---|---|
| A1 | 3.02 | 1.02 | 0.031 | 0.002 | 0.0045 | 0.0035 | 0.007 | 0.0002 | 0.05 | 0.05 |
| A2 | 3.54 | 0.3 | 0.05 | 0.0012 | 0.003 | 0.0012 | 0.01 | 0.009 | 0.02 | 0.003 |
| A3 | 2.52 | 0.0035 | 0.048 | 0.0029 | 0.0023 | 0.002 | 0.0094 | 0.007 | 0.05 | 0.05 |
| A4 | 2.51 | 0.0085 | 0.143 | 0.0053 | 0.0021 | 0.0034 | 0.012 | 0.003 | 0.05 | 0.05 |
| A5 | 3.08 | 0.0093 | 0.141 | 0.0061 | 0.0006 | 0.0028 | 0.0112 | 0.001 | 0.05 | 0.05 |
| A6 | 2.77 | 0.5 | 0.84 | 0.0012 | 0.002 | 0.0015 | 0.021 | 0.0006 | 0.07 | 0.05 |
| A7 | 2.65 | 0.4 | 0.3 | 0.0012 | 0.0023 | 0.0053 | 0.0093 | 0.004 | 0.002 | 0.003 |

TABLE 2

| Steel | Crystal grain Diameter (μm) | Number of Surfides, Base Portion | Number of Nitrides, Base Portion | Number of Oxides, Surface Portion | Number of Surfides + Carbides + Nitrides, Surface Portion | Note |
|---|---|---|---|---|---|---|
| A1 | 123 | 43 | 263 | 18 | 154 | Comparative 1 |
| A2 | 93 | 23 | 131 | 215 | 121 | Comparative 2 |
| A3 | 88 | 49 | 31 | 123 | 84 | Inventive 1 |
| A4 | 98 | 84 | 47 | 193 | 165 | Inventive 2 |
| A5 | 104 | 148 | 16 | 148 | 132 | Inventive 3 |
| A6 | 102 | 23 | 26 | 64 | 98 | Comparative 3 |
| A7 | 147 | 31 | 126 | 98 | 123 | Comparative 4 |

TABLE 3

| Steel | Iron Loss W10/400 (W/kg) | 50 Hz, Bm = 1.0 T, Relative magnetic permeability | 400 Hz, Bm = 1.0 T, Relative magnetic permeability | 1000 Hz, Bm = 0.3 T, Relative magnetic permeability | 50 Hz, Bm = 1.0 T, Rolling Direction Relative magnetic permeability | 400 Hz, Bm = 1.0 T, Rolling Direction Relative magnetic permeability | 1000 Hz, Bm = 0.3 T, Rolling Direction Relative magnetic permeability | Note |
|---|---|---|---|---|---|---|---|---|
| A1 | 13.52 | 7003 | 4325 | 2750 | 9865 | 5312 | 3212 | Comparative 1 |
| A2 | 11.94 | 7154 | 5243 | 2830 | 10345 | 5632 | 3214 | Comparative 2 |
| A3 | 10.26 | 10432 | 6931 | 3541 | 11234 | 7545 | 4023 | Inventive 1 |
| A4 | 9.43 | 10542 | 6641 | 3264 | 11542 | 7321 | 4164 | Inventive 2 |
| A5 | 9.71 | 11219 | 7636 | 3607 | 12131 | 8345 | 4323 | Inventive 3 |
| A6 | 11.75 | 7850 | 6943 | 2950 | 10453 | 7325 | 3843 | Comparative 3 |
| A7 | 12.59 | 7520 | 5431 | 2834 | 9540 | 6843 | 3125 | Comparative 4 |

Example 2

A slab composed of the alloy component and the balance iron and other unavoidable impurities according to Table 4 was prepared. Steel slabs B to D were heated at 1100° C., hot-rolled to a thickness of 2.0 mm, and wound at 600° C. The hot-rolled steel sheet cooled in air was annealed at 1100° C. for 4 minutes, pickled, and then cold-rolled to a thickness of 0.2 mm. The cold-rolled specimens were annealed at 1000° C. for the period of time set forth in Table 6 below.

In this case, inclusions and precipitates were analyzed by FE-TEM for each specimen, and the components of the precipitate inclusions were examined. The results are shown in Table 5. At this time, for the number of precipitates, only the precipitates having a diameter of 10 nm to 100 nm per unit area of 250 $\mu m^2$ were selected and counted. At this time, the specimen was sampled in the thickness direction from the surface to the inside and analyzed by dividing the portion up to 2 μm from the surface as the surface portion and the portion over 2 μm from the surface as the base portion.

The diameter of the crystal grains was measured by using an optical microscope, and the number of crystal grains was measured in a unit area, and the diameter of the crystal grains was determined as the average crystal grain size. The types and the number of inclusions and precipitates were investigated using EDS of FE-TEM, and the observed area was examined at 20 times or more at a magnification of 30,000.

The magnetic permeability and iron loss of the specimens were measured by using a magnetometer, and the results are shown in Table 6 below.

TABLE 4

| Steel (wt %) | Si | Al | Mn | S | N | C | Cu | O | Sn | P |
|---|---|---|---|---|---|---|---|---|---|---|
| B | 3 | 0.005 | 0.1 | 0.005 | 0.0027 | 0.0022 | 0.007 | 0.0005 | 0.04 | 0.07 |
| C | 3.3 | 0.007 | 0.3 | 0.003 | 0.0017 | 0.0014 | 0.004 | 0.0009 | 0.07 | 0.03 |
| D | 2.9 | 0.87 | 0.23 | 0.0043 | 0.0027 | 0.0024 | 0.011 | 0.0017 | 0.09 | 0.04 |

TABLE 5

| Steel | Crystal grain Diameter (μm) | Number of Surfides, Base Portion | Number of Nitrides, Base Portion | Number of Oxides, Surface Portion | Number of Surfides + Carbides + Nitrides, Surface Portion | Note |
|---|---|---|---|---|---|---|
| B | 31 | 11 | 21 | 27 | 14 | Comparative 5 |
| B | 47 | 13 | 18 | 21 | 25 | Comparative 6 |
| B | 64 | 116 | 12 | 35 | 21 | Inventive 4 |
| B | 94 | 21 | 15 | 41 | 31 | Inventive 5 |
| B | 146 | 20 | 16 | 26 | 17 | Inventive 6 |
| B | 206 | 16 | 21 | 34 | 18 | Comparative 7 |
| B | 247 | 13 | 24 | 46 | 29 | Comparative 8 |
| C | 32 | 5 | 20 | 41 | 21 | Comparative 9 |
| C | 49 | 16 | 17 | 35 | 25 | Comparative 10 |
| C | 61 | 107 | 8 | 113 | 46 | Inventive 7 |
| C | 95 | 38 | 22 | 64 | 31 | Inventive 8 |
| C | 143 | 18 | 14 | 36 | 8 | Inventive 9 |
| C | 202 | 13 | 29 | 19 | 21 | Comparative 11 |
| C | 225 | 11 | 19 | 56 | 19 | Comparative 12 |
| D | 23 | 5 | 53 | 119 | 76 | Comparative 13 |
| D | 3 | 33 | 94 | 196 | 96 | Comparative 14 |
| D | 51 | 139 | 5 | 554 | 3 | Inventive 10 |
| D | 75 | 97 | 40 | 115 | 11 | Inventive 11 |
| D | 83 | 31 | 2 | 153 | 4 | Inventive 12 |
| D | 213 | 37 | 39 | 79 | 6 | Comparative 15 |
| D | 203 | 42 | 88 | 97 | 60 | Comparative 16 |

TABLE 6

| Steel | Final Annealing Time (min) | Iron Loss W10/400 (W/Kg) | 50 Hz, Bm = 1.0 T, Relative magnetic permeability | 400 Hz, Bm = 1.0 T, Relative magnetic permeability | 1000 Hz, Bm = 0.3 T, Relative magnetic permeability | 50 Hz, Bm = 1.0 T, rolling direction Relative magnetic permeability | 400 Hz, Bm = 1.0 T, rolling direction Relative magnetic permeability | 1000 Hz, Bm = 0.3 T, rolling direction Relative magnetic permeability | Note |
|---|---|---|---|---|---|---|---|---|---|
| B | 0.1 | 14.2 | 8231 | 4356 | 2736 | 9876 | 4866 | 2955 | Comparative 5 |
| B | 0.5 | 12.01 | 9123 | 5412 | 2934 | 10901 | 6159 | 3217 | Comparative 6 |
| B | 1.3 | 10.11 | 11245 | 7081 | 3569 | 13476 | 7982 | 3897 | Inventive 4 |
| B | 2 | 10.09 | 13210 | 8023 | 3705 | 15842 | 9120 | 4017 | Inventive 5 |
| B | 3.5 | 10.32 | 12312 | 7452 | 3591 | 14691 | 8407 | 3886 | Inventive 6 |
| B | 5 | 12.21 | 8741 | 4566 | 2813 | 10404 | 5127 | 3080 | Comparative 7 |

TABLE 6-continued

| Steel | Final Annealing Time (min) | Iron Loss W10/400 (W/Kg) | 50 Hz, Bm = 1.0 T, Relative magnetic permeability | 400 Hz, Bm = 1.0 T, Relative magnetic permeability | 1000 Hz, Bm = 0.3 T, Relative magnetic permeability | 50 Hz, Bm = 1.0 T, rolling direction Relative magnetic permeability | 400 Hz, Bm = 1.0 T, rolling direction Relative magnetic permeability | 1000 Hz, Bm = 0.3 T, rolling direction Relative magnetic permeability | Note |
|---|---|---|---|---|---|---|---|---|---|
| B | 10 | 12.35 | 8454 | 4521 | 2801 | 10099 | 5125 | 3038 | Comparative 8 |
| C | 0.1 | 14.83 | 7231 | 4123 | 2700 | 8589 | 4646 | 2879 | Comparative 9 |
| C | 0.5 | 12.35 | 8341 | 5207 | 2834 | 9909 | 5904 | 3055 | Comparative 10 |
| C | 1.3 | 10.37 | 11197 | 6991 | 3560 | 13425 | 7915 | 3853 | Inventive 7 |
| C | 2 | 10.33 | 12843 | 7890 | 3704 | 15322 | 8985 | 4000 | Inventive 8 |
| C | 3.5 | 10.63 | 12105 | 7212 | 3590 | 14500 | 8193 | 3915 | Inventive 9 |
| C | 5 | 12.54 | 8322 | 4312 | 2811 | 9898 | 4857 | 3030 | Comarative 11 |
| C | 10 | 12.83 | 8043 | 4299 | 2785 | 9574 | 4837 | 2999 | Comparative 12 |
| D | 0.1 | 13.92 | 6973 | 4323 | 2723 | 9766 | 5289 | 3148 | Comparative 13 |
| D | 0.5 | 13.39 | 7119 | 5215 | 2735 | 10306 | 5628 | 3147 | Comparative 14 |
| D | 1.3 | 10.91 | 10379 | 6858 | 3520 | 11157 | 7510 | 3964 | Inventive 10 |
| D | 2 | 10.68 | 10540 | 6569 | 3205 | 11463 | 7302 | 4115 | Inventive 11 |
| D | 3.5 | 9.93 | 11139 | 7564 | 3549 | 12119 | 8281 | 4235 | Inventive 12 |
| D | 5 | 12.90 | 7840 | 6893 | 2870 | 10422 | 7258 | 3831 | Comparative 15 |
| D | 10 | 14.34 | 7512 | 5356 | 2741 | 9523 | 6784 | 3041 | Comparative 16 |

As shown in Table 6, it was confirmed that the inventive examples in which the final annealing time is appropriately adjusted has superior magnetic properties than the comparative examples in which the final annealing time is too short or too long.

Example 3

A slab composed of the alloy component and the balance iron and other unavoidable impurities according to Table 7 was prepared. Steel slab E was heated at 1150° C., hot-rolled to a thickness of 2.0 mm, and wound at 600° C. The hot-rolled steel sheet cooled in air was annealed at the temperature and time shown in Table 8, pickled, and then cold-rolled to a thickness of 0.35 mm. The cold-rolled specimens were annealed at the temperature and time shown in Table 8, and the magnetic permeability and iron loss were measured using a magnetic measuring machine. The results are shown in Table 10 below.

In this case, inclusions and precipitates were analyzed by FE-TEM for each specimen, and the components of the precipitates and inclusions were examined, and the results are shown in Table 9. At this time, for the number of precipitates, only the precipitates having a diameter of 10 nm to 100 nm per unit area of 250 $\mu m^2$ were selected and counted. At this time, the specimen was sampled in the thickness direction from the surface to the inside and analyzed by dividing the portion up to 2 μm from the surface as the surface portion and the portion over 2 μm from the surface as the base portion.

The diameter of the crystal grains was measured by using an optical microscope, and the number of crystal grains was measured in a unit area, and the diameter of the crystal grains was determined as the average crystal grain size. The types and the number of inclusions and precipitates were investigated using EDS of FE-TEM, and the observed area was examined at 20 times or more at a magnification of 30,000.

The magnetic permeability and iron loss of the specimens were measured by using a magnetometer, and the results are shown in Table 10 below.

TABLE 7

| Steel (wt %) | Si | Al | Mn | S | N | C | Cu | O | Sn | P | Others |
|---|---|---|---|---|---|---|---|---|---|---|---|
| E | 2.5 | 0.0031 | 0.052 | 0.0051 | 0.0021 | 0.0013 | 0.0052 | 0.0003 | 0.043 | 0.051 | Ca: 0.0005<br>Ni: 0.021<br>Cr: 0.015<br>Ti: 0.0007 |

TABLE 8

| Annealing temperature of hot-rolled sheet (° C.) | Annealing time of hot-rolled sheet (min) | Final Annealing Temperature (° C.) | Final Annealing Time (min) | Satisfying Formula 2 | Note |
|---|---|---|---|---|---|
| 920 | 0.5 | 1000 | 2 | x | Comparative 17 |
| 920 | 2 | 1000 | 2 | x | Comparative 18 |
| 920 | 25 | 1000 | 2 | ○ | Comparative 19 |
| 960 | 0.1 | 1000 | 2 | x | Comparative 20 |

TABLE 8-continued

| Annealing temperature of hot-rolled sheet (° C.) | Annealing time of hot-rolled sheet (min) | Final Annealing Temperature (° C.) | Final Annealing Time (min) | Satisfying Formula 2 | Note |
|---|---|---|---|---|---|
| 960 | 0.5 | 1000 | 2 | x | Comparative 21 |
| 960 | 3.5 | 1000 | 2 | ○ | Inventive 13 |
| 960 | 5.5 | 1000 | 2 | ○ | Inventive 14 |
| 960 | 25 | 1000 | 2 | ○ | Inventive 15 |
| 1000 | 1.1 | 1000 | 2 | x | Comparative 22 |
| 1000 | 2.5 | 1000 | 2 | ○ | Inventive 16 |
| 1000 | 3.5 | 1000 | 2 | ○ | Inventive 17 |
| 1000 | 5.5 | 1000 | 2 | ○ | Inventive 18 |
| 1050 | 0.5 | 1000 | 2 | x | Comparative 23 |
| 1050 | 1.1 | 1000 | 2 | x | Comparative 24 |
| 1050 | 2 | 1000 | 2 | ○ | Inventive 19 |
| 1100 | 1.1 | 1000 | 2 | x | Comparative 25 |
| 1140 | 1.1 | 1000 | 2 | x | Comparative 26 |
| 1170 | 1.1 | 1000 | 2 | x | Comparative 27 |
| 1000 | 2.5 | 920 | 2.5 | ○ | Inventive 20 |
| 1000 | 2.5 | 960 | 2.5 | ○ | Inventive 21 |
| 1020 | 2.5 | 1000 | 2.5 | ○ | Inventive 22 |
| 1020 | 2.5 | 1050 | 2.5 | x | Comparative 28 |
| 1020 | 2.5 | 1140 | 2.5 | x | Comparative 29 |
| 1020 | 2.5 | 1170 | 2.5 | x | Comparative 30 |

TABLE 9

| Crystal Grain Diameter (μm) | Number of Surfides, Base Portion | Number of Nitrides, Base Portion | Number of Oxides, Surface Portion | Number of Surfides + Carbides + Nitrides, Surface Portion | Note |
|---|---|---|---|---|---|
| 66.1 | 312 | 327 | 143 | 312 | Comparative 17 |
| 70.9 | 213 | 217 | 126 | 59 | Comparative 18 |
| 140.9 | 32 | 53 | 154 | 59 | Comparative 19 |
| 65.9 | 208 | 215 | 154 | 95 | Comparative 20 |
| 67.2 | 174 | 205 | 115 | 375 | Comparative 21 |
| 77.0 | 76 | 43 | 156 | 124 | Inventive 13 |
| 83.9 | 64 | 51 | 182 | 116 | Inventive 14 |
| 146.1 | 43 | 23 | 174 | 72 | Inventive 15 |
| 69.8 | 98 | 106 | 130 | 55 | Comparative 22 |
| 73.2 | 135 | 97 | 169 | 143 | Inventive 16 |
| 78.0 | 165 | 121 | 147 | 120 | Inventive 17 |
| 83.3 | 182 | 143 | 157 | 117 | Inventive 18 |
| 67.0 | 228 | 252 | 108 | 231 | Comparative 23 |
| 68.6 | 132 | 146 | 102 | 125 | Comparative 24 |
| 71.6 | 98 | 85 | 176 | 142 | Inventive 19 |
| 70.3 | 42 | 57 | 126 | 47 | Comparative 25 |
| 68.9 | 267 | 295 | 123 | 505 | Comparative 26 |
| 70.3 | 412 | 417 | 113 | 135 | Comparative 27 |
| 84.7 | 163 | 131 | 45 | 108 | Inventive 20 |
| 86.9 | 154 | 105 | 54 | 123 | Inventive 21 |
| 91.4 | 186 | 106 | 193 | 105 | Inventive 22 |

TABLE 9-continued

| Crystal Grain Diameter (μm) | Number of Surfides, Base Portion | Number of Nitrides, Base Portion | Number of Oxides, Surface Portion | Number of Surfides + Carbides + Nitrides, Surface Portion | Note |
|---|---|---|---|---|---|
| 94.9 | 103 | 119 | 239 | 111 | Comparative 28 |
| 101.0 | 121 | 145 | 365 | 431 | Comparative 29 |
| 105.4 | 107 | 132 | 351 | 561 | Comparative 30 |

TABLE 10

| 50 Hz, Bm = 1.0 T, Relative magnetic permeability | 400 Hz, Bm = 1.0 T, Relative magnetic permeability | 1000 Hz, Bm = 0.3 T, Relative magnetic permeability | 50 Hz, Bm = 1.0 T, Rolling Direction Relative magnetic permeability | 400 Hz, Bm = 1.0 T, Rolling Direction Relative magnetic permeability | 1000 Hz, Bm = 0.3 T, Rolling Direction Relative magnetic permeability | Note |
|---|---|---|---|---|---|---|
| 4143 | 2845 | 1359 | 4722 | 3300 | 1611 | Comparative 17 |
| 6531 | 4508 | 2176 | 7449 | 5136 | 2470 | Comparative 18 |
| 9327 | 6485 | 3230 | 10697 | 7405 | 3661 | Comparative 19 |
| 3986 | 2739 | 1292 | 4555 | 3176 | 1540 | Comparative 20 |
| 4474 | 3114 | 1482 | 5115 | 3550 | 1774 | Comparative 21 |
| 10132 | 7068 | 3483 | 11588 | 8080 | 3997 | Inventive 13 |
| 12639 | 8810 | 4327 | 14524 | 10163 | 5014 | Inventive 14 |
| 13151 | 9134 | 4509 | 15119 | 10517 | 5256 | Inventive 15 |
| 9140 | 6308 | 3111 | 10463 | 7228 | 3563 | Comparative 22 |
| 10727 | 7420 | 3637 | 12297 | 8524 | 4217 | Inventive 16 |
| 14286 | 9990 | 4913 | 16389 | 11421 | 5709 | Inventive 17 |
| 15167 | 10589 | 5263 | 17376 | 12155 | 6055 | Inventive 18 |
| 9118 | 6366 | 3146 | 10400 | 7240 | 3591 | Comparative 23 |
| 9723 | 6799 | 3345 | 11163 | 7773 | 3798 | Comparative 24 |
| 12765 | 8923 | 4460 | 14597 | 10147 | 5059 | Inventive 19 |
| 9182 | 6364 | 3171 | 10486 | 7276 | 3600 | Comparative 25 |
| 9542 | 6673 | 3304 | 10895 | 7607 | 3746 | Comparative 26 |
| 9334 | 6479 | 3193 | 10695 | 7416 | 3646 | Comparative 27 |
| 10231 | 7104 | 3533 | 11701 | 8136 | 4038 | Inventive 20 |
| 10872 | 7603 | 3730 | 12495 | 8662 | 4287 | Inventive 21 |
| 10312 | 7153 | 3546 | 11772 | 8160 | 4052 | Inventive 22 |
| 9431 | 6523 | 3195 | 10811 | 7529 | 3726 | Comparative 28 |
| 9213 | 6350 | 3102 | 10585 | 7396 | 3673 | Comparative 29 |
| 9120 | 6318 | 3069 | 10439 | 7288 | 3631 | Comparative 30 |

As shown in Table 10, it can be confirmed that the inventive examples in which the time and temperature in the annealing and the final annealing of the hot-rolled sheet were appropriately adjusted, has superior magnetic properties than the comparative examples in which it is not suitably adjusted.

It will be understood by those of ordinary skill in the art that various changes in form and details may be made herein without departing from the spirit and scope of the present invention as defined by the following claims and their equivalents. It is therefore to be understood that the above-described embodiments are illustrative in all aspects and not restrictive.

DESCRIPTION OF SYMBOLS

100: Non-Oriented Electrical Steel Sheet 10: Surface Portion

20: Base Portion

What claimed is:

1. A non-oriented electrical steel sheet, comprising: by weight, 2.0% to 4.0% of Si; 0:0031% to 2.0% of Al; 0.0005% to 0.009% of S; 0.02% to 1.0% of Mn, 0.0005% to 0.004% of N; 0.004% or less of C excluding 0%, 0.005% to 0.07% of Cu; 0.0001% to 0.007% of O; 0.0001% to 0.003% of Ca;

individually or in a total amount of 0.05% to 0.2% of Sn or P; and the remainder comprising Fe and impurities; wherein the non-oriented electrical steel sheet is composed of a surface portion up to 2 μm from the surface of the steel sheet in the thickness direction and a base portion over 2 μm from the surface of the steel sheet in the thickness direction, wherein the number of sulfides having a diameter of 10 nm to 100 nm is larger than the number of the nitrides having a diameter of 10 nm to 100 nm, in the same area of base portion.

2. The non-oriented electrical steel sheet according to claim 1, wherein the sum of the number of sulfides having a diameter of 10 nm to 100 nm and the number of nitrides having a diameter of 10 nm to 100 nm, in the base portion, is 1 to 200 per area of 250 $\mu m^2$.

3. The non-oriented electrical steel sheet according to claim 1, wherein the number of oxides having a diameter of 10 nm to 100 nm is larger than the sum of the number of carbides, nitrides, and sulfides having a diameter of 10 nm to 100 nm, in the same area of the surface portion.

4. The non-oriented electrical steel sheet according to claim 1, wherein the number of oxides having a diameter of 10 nm to 100 nm in the surface portion is 1 to 200 per area of 250 $\mu m^2$.

5. The non-oriented electrical steel sheet according to claim 1, satisfying the following Formula 1

$$[Sn]+[P]>[Al] \quad \text{[Formula 1]}$$

[Sn], [P], and [Al] represent the contents of Sn, P and Al by weight %, respectively.

6. The non-oriented electrical steel sheet according to claim 1, further comprising 0.0005% to 0.003% by weight of Ti; and individually or in a total amount of 0.005% to 0.2% by weight of Ni or Cr.

7. The non-oriented electrical steel sheet according to claim 1, further comprising 0.005 wt % to 0.15 wt % of Sb.

8. The non-oriented electrical steel sheet according to claim 1, further comprising 0.001 wt % to 0.015 wt % of Mo.

9. The non-oriented electrical steel sheet according to claim 1, further comprising individually or in a total amount of 0.0005 wt % to 0.003 wt % of at least one of Bi, Pb, Mg, As, Nb, Se, and V.

10. The non-oriented electrical steel sheet according to claim 1, wherein the non-oriented electrical steel sheet having an average grain diameter of 50 to 200 μm.

11. The non-oriented electrical steel sheet according to claim 1, wherein the relative magnetic permeability in a condition of Bm=1.0 T at 50 Hz exceeds 8,000;

the relative magnetic permeability in a condition of Bm=1.0 T at 400 Hz exceeds 4,000; and the relative magnetic permeability in a condition of Bm=0.3 T at 1000 Hz exceeds 2,000.

12. A manufacturing method of non-oriented electrical steel sheet, comprising:

heating the slab comprising, by weight, 2.0% to 4.0% of Si;

0.0031% to 2.0% of Al;

0.0005% to 0.009% of S; 0.02% to 1.0% of Mn;

0.0005% to 0.004% of N; 0.004% or less of C, excluding 0%;

0.005% to 0.07% of Cu; 0.0001% to 0.007% of O 0.0001% to 0.003% of Ca;

individually or in a total amount of 0.05% to 0.2% of Sn or P; and the remainder comprising Fe and impurities;

hot-rolling the slab to produce a hot-rolled sheet;

annealing the hot-rolled sheet by hot-rolling;

cold-rolling the annealed hot-rolled sheet to produce a cold-rolled sheet; and final annealing the cold-rolled sheet;

wherein the step of annealing the hot-rolled sheet and the step of final annealing satisfy the following Formula 2, wherein the final annealed non-oriented electrical steel sheet is composed of a surface portion up to 2 μm from the surface of the steel sheet in the thickness direction and a base portion over 2 μm from the surface of the steel sheet in the thickness direction, wherein the number of sulfides having a diameter of 10 nm to 100 nm is larger than the number of nitrides having a diameter of 10 nm to 100 nm in the same area of the base portion, and wherein:

$$[\text{Hot-rolled sheet annealing temperature}]\times[\text{Hot-rolled sheet annealing time}]>[\text{Final annealing temperature}]\times[\text{Final annealing time}] \quad \text{[Formula 2]}$$

[Hot-rolled sheet annealing temperature] and [Final annealing temperature] indicate the temperature in ° C. in the hot-rolled sheet annealing step and the final annealing step, respectively, and [Hot-rolled sheet annealing time] and [Final annealing time] indicate the time in minutes in the hot-rolled sheet annealing step and the final annealing step, respectively.

13. The manufacturing method of non-oriented electrical steel sheet according to claim 12, wherein the slab is heated at a temperature of from 1100° C. to 1200° C. in the step of heating the slab.

14. The manufacturing method of non-oriented electrical steel sheet according to claim 12, wherein the annealing is performed at a temperature of 950° C. to 1150° C. for 1 minute to 30 minutes in the step of annealing the hot-rolled steel sheet.

15. The manufacturing method of non-oriented electrical steel sheet according to claim 12, wherein the annealing is performed at a temperature of 900° C. to 1150° C. for 1 minute to 5 minutes, in the final annealing step.

16. The manufacturing method of non-oriented electrical steel sheet according to claim 12, wherein the step of producing the cold-rolled sheet comprises a step of cold-rolling once or a step of cold-rolling at least two times with intermediate annealing in between.

* * * * *